US005173677A

United States Patent [19]

Dederer et al.

[11] Patent Number: 5,173,677

[45] Date of Patent: Dec. 22, 1992

[54] SUPERCONDUCTING MAGNETIC ENERGY STORAGE SYSTEM WITH LOW FRICTION COIL SUPPORT

[75] Inventors: Jeffrey T. Dederer, Wilkins Township; Donald T. Hackworth, Monroeville; James A. Hendrickson, New Sewickley Twp.; David Marschik, Murrysville, all of Pa.

[73] Assignee: Westinghouse Electric Corp., Pittsburgh, Pa.

[21] Appl. No.: 621,137

[22] Filed: Dec. 3, 1990

[51] Int. Cl.[5] ..... H01F 1/00

[52] U.S. Cl. ..... 335/216; 335/299

[58] Field of Search ..... 361/19; 505/879, 883; 335/296, 299, 300, 216

[56] References Cited

U.S. PATENT DOCUMENTS

| | | | |
|---|---|---|---|
| 3,919,677 | 11/1975 | Young et al. | 335/216 |
| 3,980,981 | 9/1976 | Boom et al. | 335/216 |
| 4,622,531 | 11/1986 | Eyssa et al. | 335/216 |
| 4,896,126 | 1/1990 | Wollan et al. | 335/299 |
| 4,912,443 | 3/1990 | Heyne et al. | 335/216 |

*Primary Examiner*—Leo P. Picard
*Assistant Examiner*—Trinidad Korka
*Attorney, Agent, or Firm*—A. C. Addessi

[57] ABSTRACT

A superconducting magnetic energy (SMES) system having an axially sectioned multilayered solenoid coil immersed in a liquid helium bath contained in annular helium vessel includes as an interface between each section of the inner and outer layers of the coil and the helium vessel a finger plate assembly comprising a plurality of electrically nonconductive finger plates clamped at one end with spacers between adjacent finger plates to hanger plates welded to the helium vessel walls. The other ends of the finger plates are interleafed with the turns of the coil and clamped together with the coil turns by clamping assemblies which clamp the turns in adjacent layers of the coil. Loading bars between the layers transmit the radial loads generated by the magnetic and thermal forces acting on the coil to the finger plates. The radial loads pass through the finger plates to the helium vessel side walls and then through radial struts outside the helium vessel to the walls of a trench in which the SMES system is installed. Axial loads on the coil produced by the Lorentz force and differential thermal expansion and contraction of the coil relative to the helium vessel are absorbed in bending of the finger plates.

20 Claims, 5 Drawing Sheets

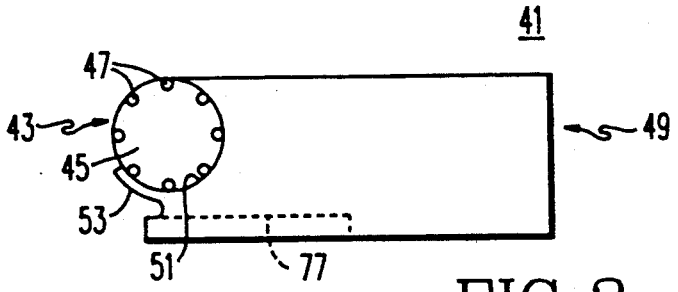
FIG. 3
FIG. 4
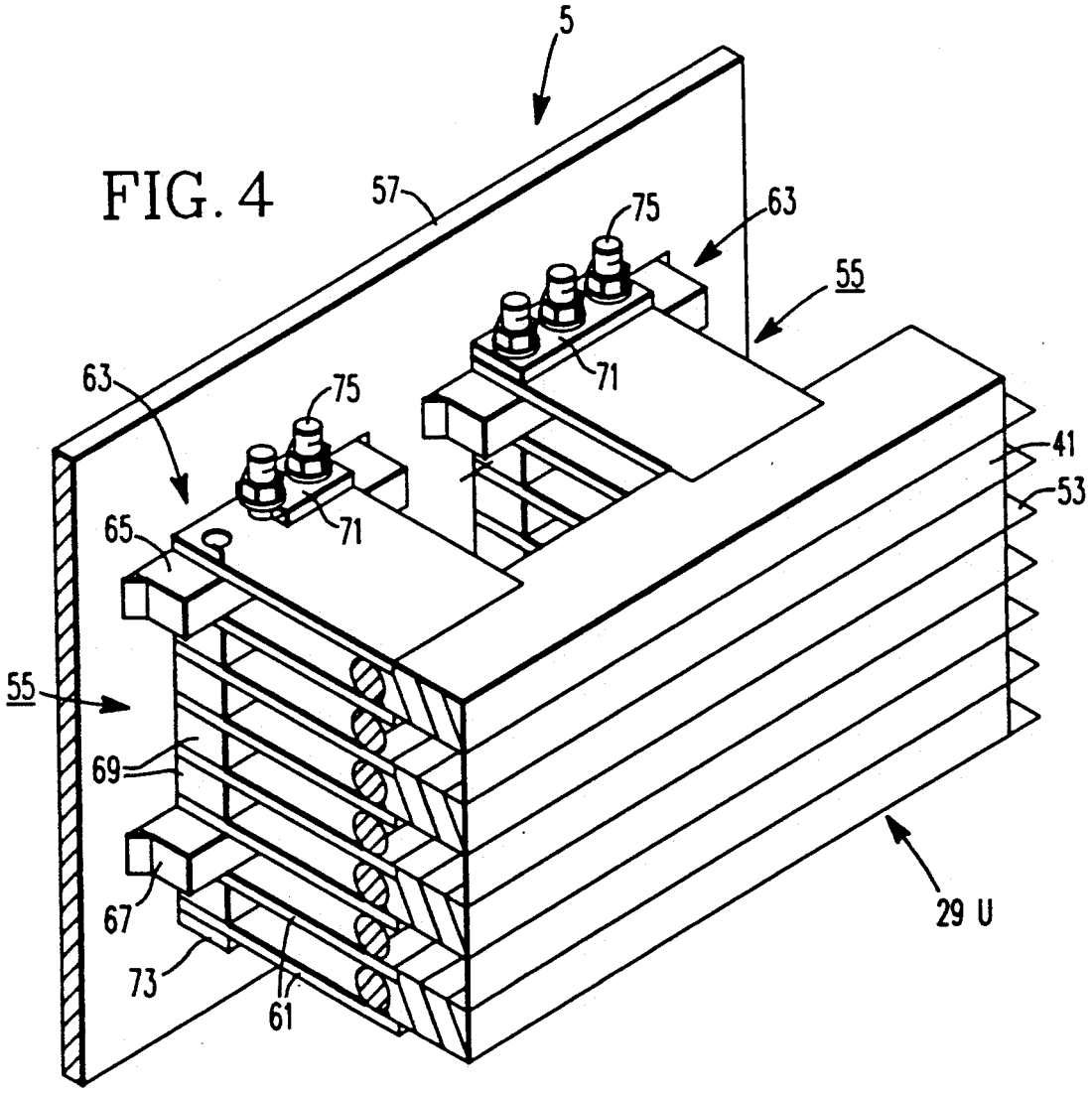

SUPERCONDUCTING MAGNETIC ENERGY STORAGE SYSTEM WITH LOW FRICTION COIL SUPPORT

The U.S. government has a paid-up license in this invention and the right in limited circumstances to require the patent owner to license others on reasonable terms as provided for by the terms of Contract No. DNA 001-88-C-0027 awarded by the Defense Nuclear Agency.

BACKGROUND OF INVENTION

1. Field of Invention

This invention relates to superconducting magnetic energy storage (SMES) systems, and more particularly to SMES systems with a support structure for a large solenoid coil which accommodates for strain due to magnetic and thermally induced forces with negligible frictional energy, released to the helium bath in which the coil is immersed.

2. Background Information

Large superconducting magnetic energy storage (SMES) systems are of interest to utilities for load leveling applications and the military for powering ground based laser systems. Such devices include a very large superconducting coil which can be several hundred meters in radius. The entire coil is immersed in a helium bath at 1.8° K. contained within a stainless steel vessel.

The coils used in these SMES systems are multiturn superconducting solenoid coils. The very large currents circulated in these coils produce large magnetic fields which combine with the current to produce a radially outward Lorentz force. In multilayer solenoid coils, the Lorentz force on the outer turns is radially inward, but the force on the inner turns is radially outward and of greater magnitude resulting in a net radially outward force. Typically, an even number of layers are used to minimize the net outward force; however, even so, the resultant outward radial force remains sizable. In theory, this load could be absorbed entirely by the coil structure by providing enough structure cross section to maintain the resulting hoop stresses within allowable limits. Practically though, for the large size coils, this becomes uneconomical due to the huge amounts, and costs, of the additional structural material.

An alternative to making the coil conductors large enough to sustain the hoop stresses produced by the Lorentz force is to provide radial supports around the coil that can transmit the load to a foundation structure, thus reducing the radial strain on the coil. An example of such an approach is illustrated in U.S. Pat. No. 3,980,981 wherein a single layer coil is mounted in a trench with a support structure extending radially outward to transmit the radial forces developed in the coil outward to the outer trench wall, or with a similar structure extending radially inward to transmit these forces to the inner wall of the trench. The turns of the coil are rippled in the plane of the turn to reduce the tensile loads on the conductor.

In order to transmit the radial load to a foundation structure, it is necessary to provide an interface between the coil structure and the helium vessel wall to which the radial support struts are mounted. In addition to the radial load component, there exists an axial load component produced by the Lorentz force which acts to compress the coil structure. This axial strain causes a net relative movement of the coil relative to the helium vessel wall when the coil is under operation. Additional relative axial movement results during the cool down from room temperature to 1.8° K. since the stainless steel helium vessel contracts only 70% as much as the aluminum coil structure. It is very important when designing superconducting equipment to keep heat generation within the helium bath to a minimum. Excessive heating of the conductor in one area beyond the ability of the helium bath to remove the heat can cause the conductor to lose its superconductivity and become resistive, thus generating more heat and eventually quenching the coil.

It is an object of the present invention, therefore, to provide an SMES system with an improved support structure for the coil.

It is a more particular object of the invention to provide such an improved support structure for transmitting the radial load between the coil and the helium vessel.

It is also an object of the invention to provide such an improved support structure which accommodates for relative axial movement between the coil and the helium vessel.

It is an additional object of the invention to provide such an improved support structure in which frictional heat generation is minimized.

It is still another object of the invention to provide such an improved SMES with a support structure which maintains the coil electrically insulated from the helium vessel walls and maintains electrical insulation between axial turns of the coil.

SUMMARY OF THE INVENTION

These and other objects are realized by the invention which is directed to a superconducting magnetic energy storage (SMES) system in which the solenoid coil is laterally supported in the helium vessel by finger plate assemblies mounted on the inner and outer side walls of the helium vessel and extending radially to the coil. The finger plate assemblies include a plurality of elongated finger plates which are mounted at one end to the side wall of the helium vessel by mounting means with the other ends interleafed with the conductors forming the turns of the coil. The radial forces developed in the coil are taken longitudinally by the finger plates to the helium vessel side walls where they are transmitted to the external support system. The axial compression forces applied to the coil when the coil is energized and the axial movement of the coil relative to the helium vessel side walls due to the thermal expansion and contraction are absorbed by the finger plates in bending.

The conductor forming the coil comprises a superconducting cable and a coextensive support member. The finger plates which are interleafed with the turns of the coil are received in radial slots in the support members of the conductors. The conductors and therefore, the finger plates also are clamped together. As the support members of the conductors are electrically conductive, insulation is provided between the turns and the finger plates are made of insulating material, preferably G-10 material.

In a two layer solenoid coil, a finger plate assembly on the inner wall of the helium vessel engages the inner layer of the coil while the outer layer of the coil is engaged by a finger plate assembly secured to the outer helium vessel wall. The inner and outer layers are clamped by a common clamping device having upper and lower clamping blocks with clamping bolts extending axially through a radial gap between the inner and outer layers. Axially extending, nonconductive loading bars transmit radial loads across the gap between the inner and outer layers. In coils having more than two winding layers, such electrically nonconductive loading bars are provided in the radial gaps between each of the layers. In coils with four layers, the two inner layers are clamped together by a common clamping device, and the two outer layers are also clamped together by common clamping device. The two inner layers are not clamped together; however, loading bars again transmit radial forces across the gaps between layers.

In coils divided into axially spaced sections, separate inner and outer finger plate assemblies are included for each section. The sections can be axially tied together by a common clamping plate between the two sections.

BRIEF DESCRIPTION OF THE DRAWINGS

A full understanding of the invention can be gained from the following description of the preferred embodiments when read in conjunction with the accompanying drawings in which:

FIG. 3 is an end view of a conductor in the coil which is shown in FIG. 2.

FIG. 4 is a fragmentary isometric view of a section of the coil of the SMES system of the invention in which the number of turns have been reduced to illustrate the construction of the interface between the coil and the dewar.

DESCRIPTION OF THE PREFERRED EMBODIMENTS

Figure 1:
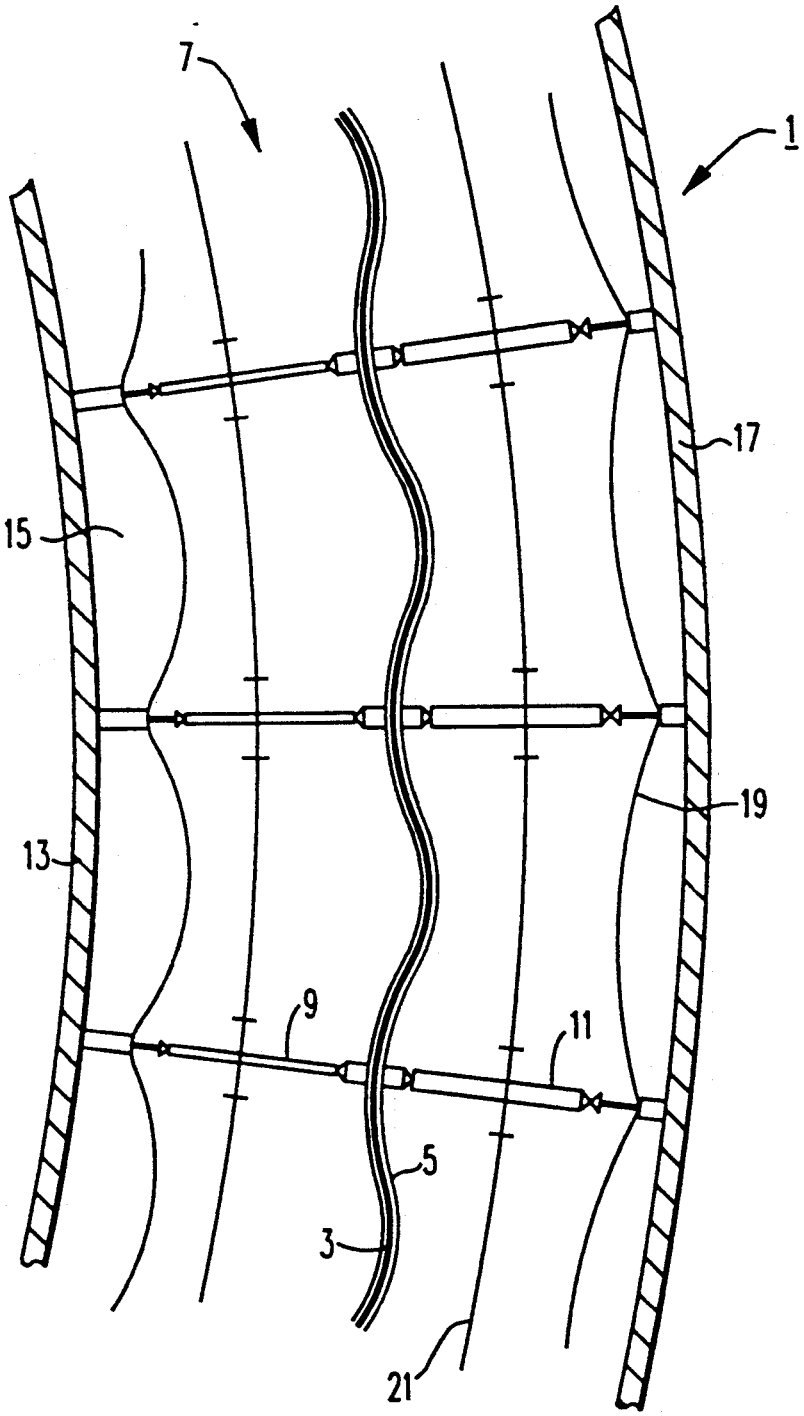
FIG. 1 is a fragmentary schematic plan view of a section of a superconducting magnetic energy storage system in accordance with the invention.

Referring to FIG. 1, the SMES system 1 of the invention includes a solenoid coil 3 with a radius of several hundred meters immersed in liquid helium contained in an annular helium vessel 5. The solenoid coil 3 has undulations or ripples in the plane of the turns of the coil to reduce stresses in the coil as is known.

The helium vessel 5 is laterally supported by an external support structure 7 which includes inner radial struts 9 and outer radial struts 11 which engage the dewar at each of the points of minimum radius of the undulating turns. The inner struts are connected to an inner wall 13 of a trench 15 in which the SMES is mounted while the outer struts are connected to the outer trench wall 17. In the exemplary system, eighty-four pairs of inner and outer struts 9 and 11 are angularly spaced around the annular helium vessel. The helium vessel 5 is enclosed in a vacuum vessel 19. A shroud 21 having a pattern of tubes through which liquid nitrogen is circulated is positioned between the wall of the vacuum vessel 19 and the helium vessel 5 to reduce the thermal load on the helium vessel, which as mentioned contains superfluid helium at 1.8° K.

Figure 2:
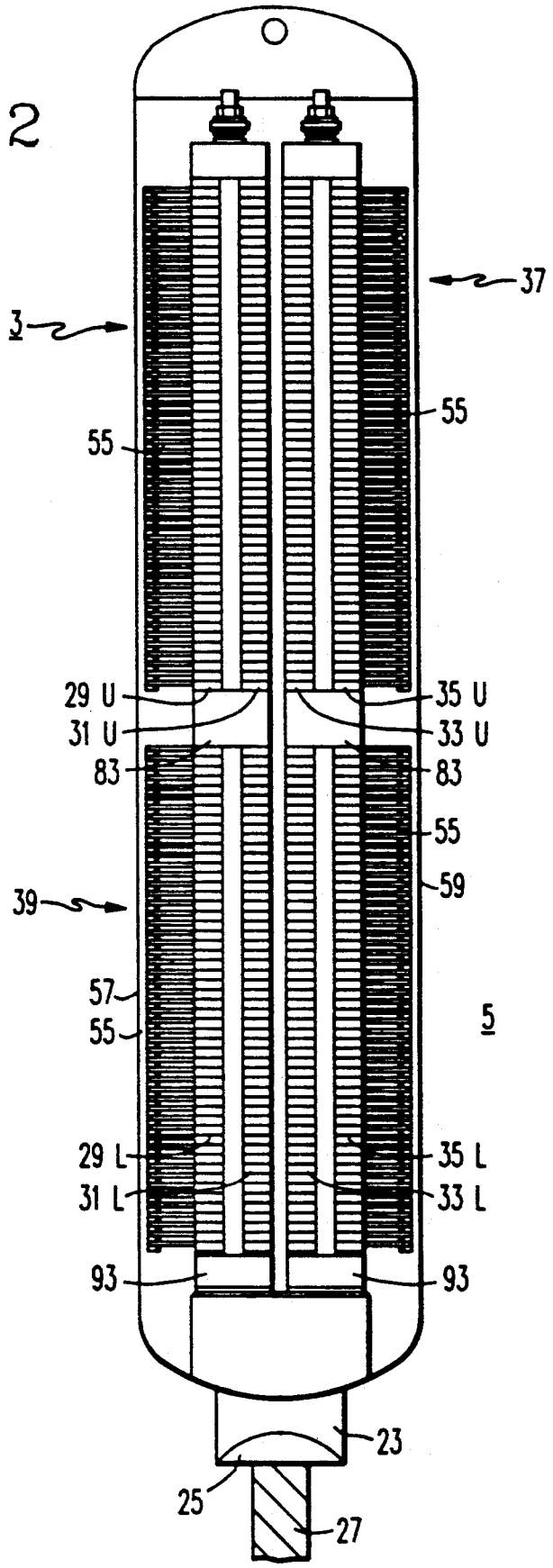
FIG. 2 is a vertical section through the dewar and solenoid coil which form a part of the SMES system illustrated in FIG. 1.

An enlarged cross section through the helium vessel 5 is shown in FIG. 2. The helium vessel is supported vertically at points in the same lane as the inner and outer struts 9 and 11 by pedestal supports 23 which engage through a ball and socket joint 25 a lower support strut 27. This ball and socket joint 25 which is outside the helium vessel 5 permits the helium vessel to move slightly in the radial directions.

The coil 3 is a multilayered solenoid coil of modular construction. In the exemplary embodiment, the coil 3 has four winding layers 29, 31, 33 and 35. Each winding layer is divided into an upper section 29U, 31U, 33U and 35U forming the upper module 37, and a lower section 29L, 31L, 33L and 35L forming a lower module 39. The winding layers in each module are connected in one or more series circuits, and the upper and lower modules can be connected in series or parallel by connectors (not shown) as desired.

Each section of each layer of the solenoid coil 3 has multiple turns of a conductor 41. As shown in FIG. 3, the conductors 41 forming the turns of the solenoid coil 3 include a superconducting cable 43 having a core 45 of high purity aluminum and a plurality of superconducting strands 47 seated in grooves around the periphery of the core 45.

The conductor 41 also includes a generally rectangular aluminum support member 49 which is coextensive with the cable 43 and has a longitudinal groove 51 in which the cable 43 is received. A lip 53 retains the cable 43 in the groove 51.

The conductors 41 forming the turns of each section of each layer of the solenoid coil are stacked one on top of the other with a layer 53 of insulation in between as shown in FIG. 4 for the upper winding layer 29U. Aligned with each inner and outer strut, a pair of finger plate assemblies 55 form an interface between the conductors 41 forming the coil turns and the inner and outer walls 57 and 59 of the helium vessel 5. Each finger plate assembly 55 includes a plurality of elongated finger plates 61 interleafed with the conductors 41. One end of each of the finger plates 61 is clamped by a mounting unit 63 which includes upper and lower hanger blocks 65 and 67 welded to the adjacent wall 57 or 59 of the helium vessel 5. The ends of the finger plates 61 are separated by stainless steel spacer blocks 69 with the hanger blocks 65 and 67 forming a spacer for the top and bottom and the adjacent finger plates. The stack of finger plates and spacer blocks are clamped together between stainless steel upper and lower clamping blocks 71 and 73, respectively, by bolts 75 extending through the stack. The other ends of the finger plates 61 are received in radially extending slots 77 in the support members 49 of the conductors 41. The finger plates 61 are made of a resilient electrically insulating material, such as G-10 material with the laminations extending longitudinally along the plates. Only a few of the turns of the coil section are shown in FIG. 4 for clarity of presentation. As can be seen from FIG. 2, the number of turns and hence the number of finger plates would typically be much greater in a practical SMES system.

Figure 5:
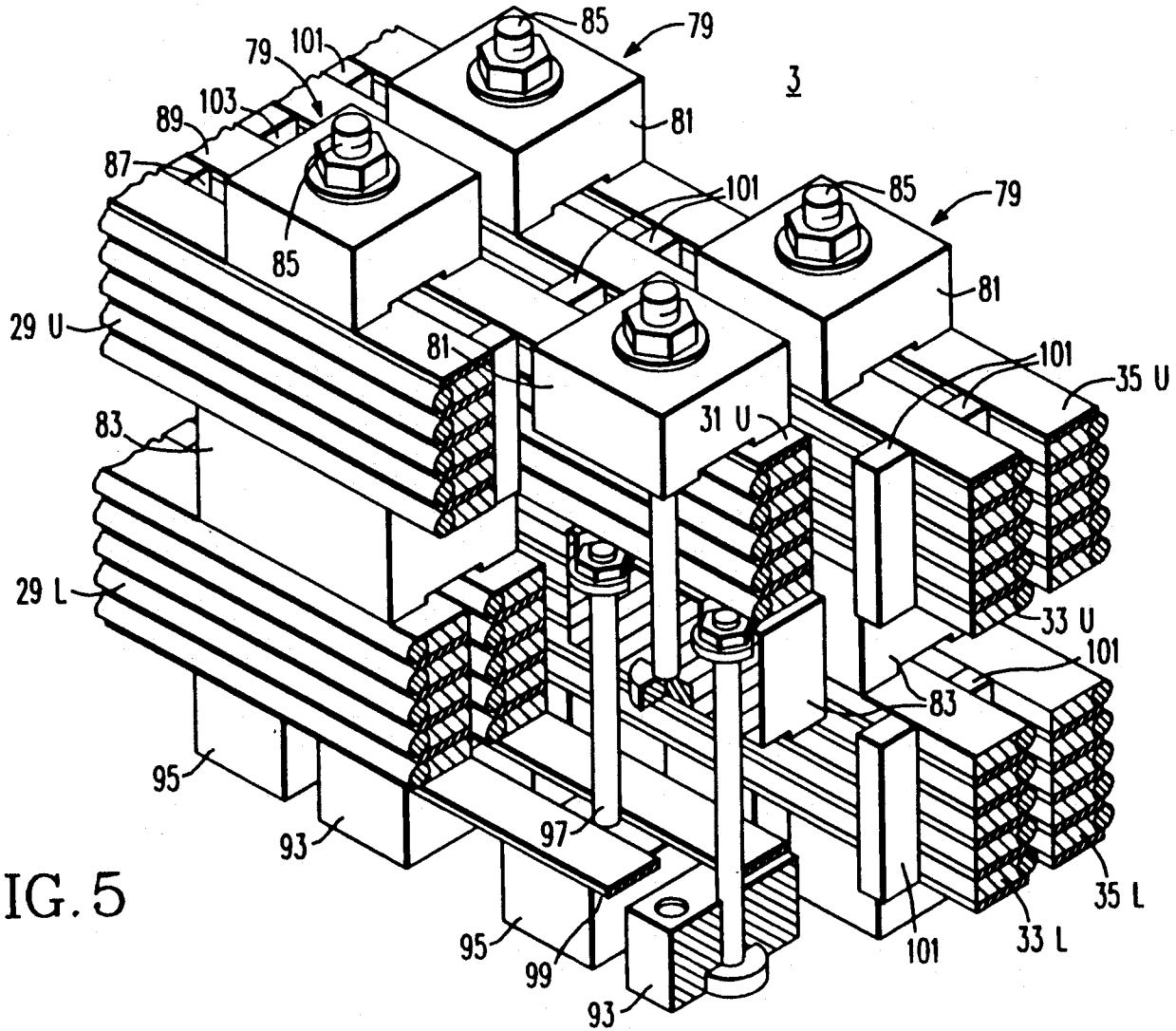
FIG. 5 is a fragmentary isometric view with some parts cut away, and again with some turns of the coil eliminated, to show the clamping of adjacent layers of coil sections in accordance with the invention.

FIG. 5 illustrates, again with a reduced number of turns, the clamping of the conductors in each section of each layer of the solenoid coil 3 and the clamping together of the upper and lower sections. The conductors of the upper section of the inner layer 29U of the solenoid coil and the upper section of the layer 31U are clamped together at spaced intervals by clamp assemblies 79 which include upper G-10 clamping plates 81 and mid-plane clamping plates 83 drawn together by bolts 85 which extend through the radial gap 87 between the layers 29 and 31. The bolts 85 are electrically insulated from the adjacent conductors by insulating sleeves. A top conductor retaining plate 89 insulates the upper clamping plate from the conductors of the coil sections 29U and 31U.

The clamping assembly 91 for the lower sections 29L and 31L of the layers 29 and 31 includes the mid-plane clamping plate 83 which is above the sections 29L and 31L and a pair of lower clamping plates 93 and 95 which are clamped to the mid-plate by bolts 97 with insulating sleeves. Lower conductor plates 99 extend along the bottom of the stacks 29L and 31L between the conductors and the lower clamping plates 93 and 95. The bolts 97 extend through the radial gap 87 between the layers 29 and 31. Electrically nonconductive loading bars 101, preferably made of G-10 material, extend axially in the radial gap 87 between each of the clamping assemblies 79. Similar upper and lower clamping assemblies 79 and 91 clamp the upper section 33U and 35U and the lower section 33L and 35L respectively together in the same manner. Again, electrically nonconductive loading bars 101 extend axially along the radial gap between the layers 33 and 35 between the clamping assemblies. The adjacent sections 31U and 33U, as well as the sections 31L and 33L are not clamped together; however, insulating loading bars 101 are located in the radial gap 103 between the layers 31 and 33 in alignment with the other loading bars 101.

It should be appreciated that the solenoid 3 may have any number of layers, and preferable an even number. Each pair of layers is clamped in the manner described in connection with FIG. 5. In the case of a coil with only two layers, those two layers are clamped together with each of the layers in the pair connected to the adjacent helium vessel wall by a finger plate assembly 55.

Figure 6:
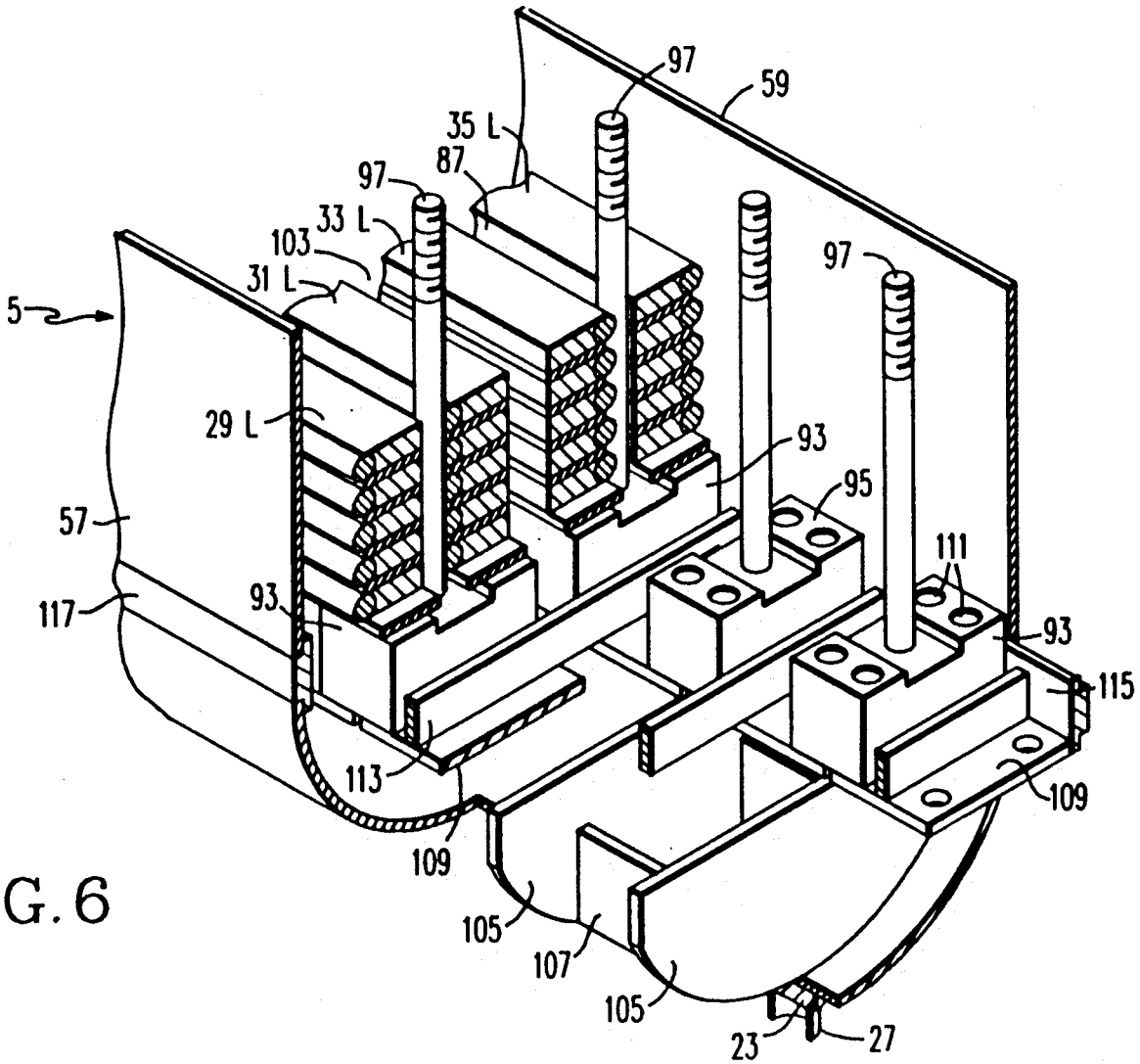
FIG. 6 is a fragmentary isometric view with some parts removed and other parts in section illustrating a lower support for the coil of the SMES system of the invention.

FIG. 6 illustrates the lower support for the solenoid coil 3. At each of the lower pedestal supports 23 is a pair of transverse saddle support plates 105 tied together by longitudinally extending saddle stiffener plates 107. The lower clamping plates 93 and 95 are connected by a series of coil base plates 109 secured to the lower clamping plates by bolts 111. The coil base plates 109 rest on the saddle plates 105. Lower tie bars 113 extend transversely between ring seam plates 115 and 117 in the inner and outer helium vessel walls 57 and 59, respectively.

In operation, the helium vessel 5 is filled with superfluid helium which lowers the temperature of the conductors to 1.8° K. As previously mentioned, under these conditions, the stainless steel helium vessel 5 contracts only about 70% as much as the aluminum coil structure. To accommodate for this difference in thermal contraction, the finger plates 61 bend. This cool down of the coil also generates a radially inward load on the coils. This load is transmitted between the layers of the coil by the loading bars 99 and 101 and through the finger plates 61 of the finger plate assembly secured to the inner helium vessel wall 57 to the inner struts 9 of the external support structure 7 and hence to the inner trench wall 13. When current is circulated through the coil, the net outward radial force on the layers of the solenoid coil 3 is transmitted between layers again by the loading bars 99 and 103 and through the finger plates 61 of the outer finger plate assemblies to the outer wall 59 of the helium vessel 5 and then through the outer struts 11 to the outer trench wall 17. The strain resulting from the axial compression forces acting on the coil when current is circulated through the coil are also taken in bending of the finger plates. The entire helium vessel can pivot outward on the ball and socket joint 25 in reaction to the net radially outward force produced when current flows through the solenoid coil 3.

As can be appreciated, the radial and axial loads placed on the solenoid coil 3 in the described SMES system are accommodated without generating appreciable frictional heat within the helium vessel.

While specific embodiments of the invention have been described in detail, it will be appreciated by those skilled in the art that various modifications and alternatives to those details should be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A superconducting magnetic energy storage system comprising:

an annular vessel having inner and outer walls and containing a cryogenic fluid;

external support means reacting against readily inward and outward forces acting on said inner and outer walls of said vessel respectively;

a solenoid coil immersed in said cryogenic fluid in said vessel and having at least first and second winding layers each comprising conductor means forming multiple axially aligned turns, said conductor means of said at least first and second winding layers of said solenoid coil producing a net inward radial force and relative axial movement between said solenoid coil and vessel as said conducting means are cooled down by said cryogenic fluid in said vessel without current applied to the conductor means, and with current applied to said solenoid coil generating a net outward radial force and axial forces tending to axially compress said turns of each layer of the solenoid coil;

a plurality of first finger plates interleaved with and engaging the conductor means of said first winding layer of said solenoid coil;

a plurality of second finger plates interleaved with and engaging the conductor means of said second winding layer of said solenoid coil;

first mounting means mounting each of the first finger plates at one end to the inner wall of said vessel with the other the end of the first finger plates extending radially outward and interleaving with said conductor means of said first winding layer of said coil;

second mounting means mounting each of the second finger plates at one end to the outer wall of said vessel with the other end of said second finger plates extending radially inward and interleaving with said conductor means of said conductor means of said second winding layer of said solenoid coil; and electrically insulating spacer means between said conductor means of said at least first and second winding layers of said solenoid coil;

said first finger plates transmitting said net inward radial force from said conductor means to said external support means through said inner vessel wall when said conductor means are cooled down without current applied to said solenoid coil, and said second finger plates transmitting said net outward radial force from said conductor means to said external support means through said outer vessel wall when current is applied to said solenoid coil, and both said first and second elongated finger plates bending in response to said axial forces and relative axial movement between said solenoid coil and vessel.

2. The system of claim 1 including clamping means clamping said conductor means forming the axially aligned turns of each layer of said solenoid coil together.

3. The system of claim 2 wherein said conductor means include a superconducting cable and a support member coextensive with said superconducting cable, said finger plates engaging said support member of the conductor means.

4. The system of claim 3 wherein said support members include a radially extending slot in which a finger plate is received and clamped by said clamping means.

5. The system of claim 4 wherein said support member of said conductor means is electrically conductive, and including layers of insulation between the turns formed by said conductor means.

6. The system of claim 5 wherein said finger plates are electrically nonconductive.

7. The system of claim 1 wherein each of said first and second winding layers of said solenoid coil comprise first and second axially spaced sections with each section comprising conductor means forming axially aligned turns, and including first and second elongated finger plates angularly spaced around and associated with each said section, and first and second mounting means for the finger plates associated with each section mounting first ends of the finger plates of each section to the inner and outer vessel walls respectively with second ends of said finger plates extending toward and engaging the conductor means of the associated section of the first and second winding layers, respectively.

8. The system of claim 7 including clamping means clamping the conductor means in each section of each winding layer together.

9. The system of claim 8 wherein said clamping means include means clamping the conductor means in the first section of each winding layer to the conductor means in the second section of the winding layer.

10. The system of claim 1 wherein said solenoid coil includes third and fourth winding layers each comprising conductor means forming multiple axially aligned turns, said third and fourth winding layers of said solenoid coil being located radially between said first and second winding layers of said solenoid coil, said conductor means of said third and fourth winding layers of said solenoid coil adding to the net inward radial force when said solenoid coil is cooled down without current flowing through said solenoid coil and adding to said net radially outward force and to said axial compressing forces when current flows through said solenoid coil, said insulating spacer means including loading bars between conductor means of each layer of said solenoid coil.

11. The system of claim 10 including first clamping means simultaneously clamping the conductor means of the first and third layers of said solenoid coil, and second clamping means simultaneously clamping the conductor means of said second and fourth layers of said solenoid coil.

12. The system of claim 11 wherein each of said winding layers of said solenoid coil comprises first and second axially spaced sections with each section comprising conductor means forming axially aligned turn, and including first and second elongated finger plates angularly spaced around and engaging conductor means of each section, and mounting means mounting the first elongated finger plates of each section to said inner wall of the vessel and mounting the second elongated finger plates of each section to the outer vessel wall.

13. The system of claim 12 including first clamping means for said first and second sections of said solenoid coil clamping together the conductor means of the first and third winding layer in the section together for each section of said solenoid coil and second clamping means for said first and second sections of said solenoid coil clamping the conductor means of the second and fourth winding layers in the section together.

14. The system of claim 13 including means clamping said first clamping means for said first and second sections of the solenoid coil together and means clamping the second clamping means for said first and second sections of the solenoid coil together.

15. Apparatus for bearing radial and axial forces developed by a superconducting solenoid coil comprising conductor means forming a plurality of axially aligned turns and immersed in a bath of cryogenic fluid in an annular vessel having inner and outer annular side walls, said apparatus comprising:

a plurality of elongated finger plates interleaved with the conductor means; and mounting means mounting first ends of said elongated finger plates to a side wall of said vessel, with the other ends of said finger plates engaging the turns of said conductor means, said elongated finger plates taking said radial forces longitudinally and acting to said axial forces in bending.

16. The apparatus of claim 15 including clamping means clamping the axially aligned turns formed by said conductor means together.

17. The apparatus of claim 16 wherein said conductor means include a superconducting cable and a support member coextensive with said superconducting cable and wherein the second ends of said elongated finger plates are interleaved with said support members.

18. The apparatus of claim 17 wherein said mounting means includes hanger means fixed to said side wall of the vessel, spacers between the first ends of said finger plates and clamping means clamping the first ends of said elongated finger plates with said spacers between said hanger means.

19. The apparatus of claim 18 wherein said support members of said conductor means are electrically conductive and wherein said elongated finger plates are electrically nonconductive.

20. The apparatus of claim 19 wherein said support members of said conductor means are provided with a radially extending slot in one face thereof in which the second end of one of said elongated finger plates is seated and including electrically insulating layers between said support members of said axially aligned turns of said solenoid coil.

* * * * *